US012163686B2

(12) United States Patent
Lee et al.

(10) Patent No.: US 12,163,686 B2
(45) Date of Patent: Dec. 10, 2024

(54) DESIGNATED OUTDOOR AIR SYSTEM FOR CONTROLLING TEMPERATURE UNIFORMITY WITHIN A SPACE

(71) Applicant: LG ELECTRONICS INC., Seoul (KR)

(72) Inventors: Jukyoung Lee, Seoul (KR); Youngjoo Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 422 days.

(21) Appl. No.: 17/523,055

(22) Filed: Nov. 10, 2021

(65) Prior Publication Data

US 2022/0154965 A1 May 19, 2022

(30) Foreign Application Priority Data

Nov. 13, 2020 (KR) ..... 10-2020-0151718

(51) Int. Cl.
*F24F 11/65* (2018.01)
*F24F 7/08* (2006.01)
(Continued)

(52) U.S. Cl.
CPC ..... *F24F 11/65* (2018.01); *F24F 7/08* (2013.01); *F24F 2011/0002* (2013.01); *F24F 2110/10* (2018.01); *F24F 2110/12* (2018.01)

(58) Field of Classification Search
CPC ..... F24F 11/65; F24F 7/08; F24F 2011/0002; F24F 2110/10; F24F 2110/12
See application file for complete search history.

(56) References Cited

U.S. PATENT DOCUMENTS 6,209,335 B1 4/2001 Nowaczyk
2009/0306828 A1* 12/2009 Larsen ..... F24F 11/47 700/276

FOREIGN PATENT DOCUMENTS

CN 104742772 7/2015
CN 105605759 5/2016
(Continued)

OTHER PUBLICATIONS

Chinese Office Action dated May 6, 2023 issued in Application No. 202111327560.4.
(Continued)

*Primary Examiner* — Edelmira Bosques
*Assistant Examiner* — Michael James Giordano
(74) *Attorney, Agent, or Firm* — KED & ASSOCIATES

(57) ABSTRACT

A ventilation system according to an embodiment of the present disclosure includes: a plurality of dedicated outdoor air systems, each having one or more temperature sensors and configured to cause outdoor air to flow into an indoor space and indoor air to flow outside thereof; and a controller configured to control the plurality of dedicated outdoor air systems based on temperature data sensed by temperature sensors included in the plurality of dedicated outdoor air systems, wherein the controller: in response to temperature uniformity of the indoor space, in which the plurality of dedicated outdoor air systems are installed, satisfying a predetermined temperature uniformity criterion, controls all the dedicated outdoor air systems to operate in a first operation mode in which the dedicated outdoor air systems operate according to a set temperature; and in response to the temperature uniformity not satisfying the predetermined temperature uniformity criterion, controls the dedicated outdoor air systems to operate in a second operation mode in which at least one dedicated outdoor air system operates in
(Continued)

a mode different from that of other dedicated outdoor air systems.

6 Claims, 12 Drawing Sheets

(51) Int. Cl.
*F24F 11/00* (2018.01)
*F24F 110/10* (2018.01)
*F24F 110/12* (2018.01)

(56) References Cited

FOREIGN PATENT DOCUMENTS

| | | | | |
|---|---|---|---|---|
| JP | H04344045 | A | * | 11/1992 |
| JP | 2014-173795 | | | 9/2014 |
| JP | 2018-100791 | | | 6/2018 |
| JP | 2018100791 | A | * | 6/2018 |
| KR | 10-0901441 | | | 6/2009 |
| KR | 20120016739 | A | * | 2/2012 |
| KR | 10-2017-0025540 | | | 3/2017 |

OTHER PUBLICATIONS

Japanese Office Action dated Nov. 1, 2022 issued in JP Application No. 2021-184505.

* cited by examiner

FIG. 6

| CRITERIA FOR SET TEMPERATURE | CRITERIA FOR OUTDOOR TEMPERATURE | CRITERIA FOR INDOOR TEMPERATURE | TEMPERATURE CONTROL MODE |
|---|---|---|---|
| SET TEMPERATURE ≧OUTDOOR TEMPERATURE | INDOOR TEMPERATURE ≧ OUTDOOR TEMPERATURE | SET TEMPERATURE ≧ INDOOR TEMPERATURE | Heating |
| | | SET TEMPERATURE < INDOOR TEMPERATURE | Fan Only |
| | INDOOR TEMPERATURE < OUTDOOR TEMPERATURE | – | Heating |
| SET TEMPERATURE <OUTDOOR TEMPERATURE | INDOOR TEMPERATURE ≧ OUTDOOR TEMPERATURE | – | Cooling |
| | INDOOR TEMPERATURE < OUTDOOR TEMPERATURE | SET TEMPERATURE ≧ INDOOR TEMPERATURE | Fan Only |
| | | SET TEMPERATURE < INDOOR TEMPERATURE | Cooling |

FIG. 7A

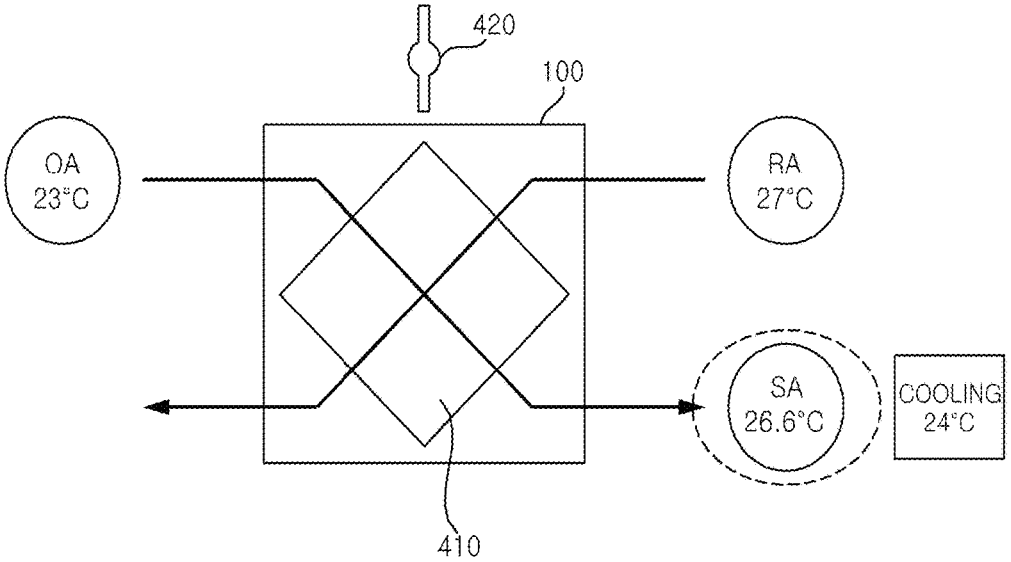

DESIGNATED OUTDOOR AIR SYSTEM FOR CONTROLLING TEMPERATURE UNIFORMITY WITHIN A SPACE

CROSS-REFERENCE TO RELATED APPLICATION(S)

This application claims priority under 35 U.S.C. § 119 to Korean Application No. 10-2020-0151718, filed in Korea on Nov. 13, 2020, whose entire disclosure(s) is/are hereby incorporated by reference.

BACKGROUND OF THE INVENTION

1. Field of the Invention

The present disclosure relates to a ventilation system and a method of operating the same, and more particularly to a ventilation system including a plurality of dedicated outdoor air systems (DOAS), and a method of operating the same.

2. Description of the Related Art

An air conditioner, which controls temperature of an indoor space by circulating indoor air, has a problem in that the air conditioner circulates only the stagnant air in the indoor space, and thus may not continuously provide comfort air for users.

Accordingly, there is an increasing interest in a ventilating apparatus for drawing in outside air and discharging indoor air so that fresh outside air may continuously flow into the indoor space.

The ventilating apparatus based on the DOAS may control the temperature of air supplied into a room by heat exchange between indoor air discharged to the outside and outdoor air supplied into the room, or may heat/cool the air drawn into the room by using an additional heating/cooling means provided therein.

Korean Laid-Open Patent Publication No. 1020150122092 discloses a ventilation system based on the DOAS, which supplies outside air into a room by heat exchange between the outside air and the indoor air, and causes the outside air to flow into the room by dehumidification using a liquid desiccant.

In addition, Korean Registered Patent No. 100901441 discloses a hybrid air-conditioning and ventilation system that performs ventilation and air-conditioning operations by connecting single heat source equipment for air conditioning with an air conditioner and an indoor air conditioning unit.

However, the ventilation system merely discloses operations of individual devices. Accordingly, in the case where a plurality of devices are installed in a specific space such as an office space in a large building, there is a need for a method of optimally controlling the plurality of devices according to circumstances.

SUMMARY OF THE INVENTION

It is an object of the present disclosure to provide a ventilation system capable of efficiently operating a plurality of dedicated outdoor air systems installed in a single indoor space, and a method of operating the same.

It is another object of the present disclosure to provide a ventilation system capable of improving indoor comfort rapidly by using the plurality of dedicated outdoor air systems, and a method of operating the same.

It is yet another object of the present disclosure to provide a ventilation system capable of achieving uniform indoor comfort by controlling the plurality of dedicated outdoor air systems based on temperature uniformity of the indoor space, and a method of operating the same.

The objects of the present disclosure are not limited to the aforementioned objects and other objects not described herein will be clearly understood by those skilled in the art from the following description.

In order to achieve the above objects, there are provided a ventilation system and a method of operating the same according to an embodiment of the present disclosure, in which by controlling a ventilation direction based on temperature circumstances of an indoor space, indoor comfort may be improved.

In accordance with an aspect of the present disclosure, the above and other objects can be accomplished by providing a ventilation system, including: a plurality of dedicated outdoor air systems, each having one or more temperature sensors and configured to cause outdoor air to flow into an indoor space and indoor air to flow outside thereof; and a controller configured to control the plurality of dedicated outdoor air systems based on temperature data sensed by temperature sensors included in the plurality of dedicated outdoor air systems, wherein the controller: in response to temperature uniformity of the indoor space, in which the plurality of dedicated outdoor air systems are installed, satisfying a predetermined temperature uniformity criterion, controls all the dedicated outdoor air systems to operate in a first operation mode in which the dedicated outdoor air systems operate according to a set temperature; and in response to the temperature uniformity not satisfying the predetermined temperature uniformity criterion, controls the dedicated outdoor air systems to operate in a second operation mode in which at least one dedicated outdoor air system operates in a mode different from that of other dedicated outdoor air systems.

Meanwhile, in response to there being no dedicated outdoor air system in which a difference between indoor temperature data, sensed by the indoor temperature sensors included in the respective dedicated outdoor air systems, and an average value of the indoor temperature data is greater than a reference value, the controller may control the dedicated outdoor air systems to operate in the first operation mode.

Meanwhile, in the first operation mode, the plurality of dedicated outdoor air systems may perform a heating operation or a cooling operation, or a fan only operation of operating only a fan, based on outdoor temperature, indoor temperature, and set temperature.

Meanwhile, in the first operation mode, the plurality of dedicated outdoor air systems may perform a simultaneous operation of sucking the outdoor air and discharging the indoor air simultaneously.

Meanwhile, in the second operation mode: in response to the at least one dedicated outdoor air system performing the suction operation of the outdoor air, the other dedicated outdoor air systems may perform the discharge operation of the indoor air; and in response to the at least one dedicated outdoor air system performing the discharge operation of the indoor air, the other dedicated outdoor air systems may perform the suction operation of the outdoor air.

Meanwhile, in the second operation mode: among the plurality of dedicated outdoor air systems, a dedicated outdoor air system, in which the sensed the indoor temperature data has a maximum value, may perform the discharge operation of the indoor air; among the plurality of dedicated outdoor air systems, a dedicated outdoor air system, in which the sensed the indoor temperature data has a minimum value, may perform the suction operation of the outdoor air; and the other dedicated outdoor air systems may perform the simultaneous operation of sucking the outdoor air and discharging the indoor air simultaneously.

Meanwhile, in response to there being a dedicated outdoor air system in which a difference between the indoor temperature data, sensed by the indoor temperature sensors included in the respective dedicated outdoor air systems, and an average value of the indoor temperature data is greater than a reference value, the controller may control the dedicated outdoor air system to operate in the second operation mode.

Meanwhile, in the second operation mode, the controller may control the plurality of dedicated outdoor air systems based on a number of the dedicated outdoor air system, and a number of dedicated outdoor air systems in which the difference between the sensed indoor temperature data and the average value of the indoor temperature data is greater than the reference value.

Further, in the second mode, in response to there being two dedicated outdoor air systems, one dedicated outdoor air system may perform the discharge operation of the indoor air, and the other dedicated outdoor air system may perform the suction operation of the outdoor air.

In addition, in the second operation mode, in response to there being three dedicated outdoor air systems, including one dedicated outdoor air system in which the difference between the sensed indoor temperature data and the average value thereof is greater than the reference value: a dedicated outdoor air system, in which the sensed indoor temperature data has the maximum value, may perform the discharge operation of the indoor air; and the remaining two dedicated outdoor air systems may perform the suction operation of the outdoor air.

Moreover, in the second operation mode, in response to there being three dedicated outdoor air systems, including two dedicated outdoor air systems in which the difference between the sensed indoor temperature data and the average value thereof is greater than the reference value: a dedicated outdoor air system, in which the sensed indoor temperature data has the minimum value, may perform the suction operation of the outdoor air; and the remaining two dedicated outdoor air systems may perform the discharge operation of the indoor air.

In addition, in the second operation mode, in response to there being four dedicated outdoor air systems, including one dedicated outdoor air system in which the difference between the sensed indoor temperature data and the average value thereof is greater than the reference value: a dedicated outdoor air system, in which the sensed indoor temperature data has the maximum value, may perform the discharge operation of the indoor air; and the remaining three dedicated outdoor air systems may perform the suction operation of the outdoor air.

Further, in the second operation mode, in response to there being four dedicated outdoor air systems, including two dedicated outdoor air systems in which the difference between the sensed indoor temperature data and the average value thereof is greater than the reference value: the two dedicated outdoor air systems, in which the difference between the sensed indoor temperature data and the average value thereof is greater than the reference value, may perform the discharge operation of the indoor air; and the remaining two dedicated outdoor air systems may perform the suction operation of the outdoor air.

In addition, in the second operation mode, in response to there being four dedicated outdoor air systems, including three dedicated outdoor air systems in which the difference between the sensed indoor temperature data and the average value thereof is greater than the reference value: a dedicated outdoor air system, in which the sensed indoor temperature data has a minimum value, may perform the suction operation of the outdoor air; and the remaining three dedicated outdoor air systems may perform the discharge operation of the indoor air.

In accordance with an aspect of the present disclosure, the above and other objects can be accomplished by providing a method of operating a ventilation system, the method including: determining temperature uniformity of an indoor space in which a plurality of dedicated outdoor air systems are installed; in response to the determined temperature uniformity satisfying a predetermined temperature uniformity criterion, operating the dedicated outdoor air systems in a first operation mode in which all the dedicated outdoor air systems operate according to a set temperature; and in response to the determined temperature uniformity not satisfying the predetermined temperature uniformity criterion, operating the dedicated outdoor air systems in a second operation mode in which at least one dedicated outdoor air system operates in a mode different from that of other dedicated outdoor air systems.

The method of operating a ventilation system may further include determining a heating operation mode or a cooling operation mode based on outdoor temperature, indoor temperature, and set temperature.

Meanwhile, the temperature uniformity criterion may be that there is no dedicated outdoor air system in which a difference between indoor temperature data, sensed by indoor temperature sensors included in the respective dedicated outdoor air systems, and an average value of the indoor temperature data is greater than a reference value.

Meanwhile, the operating in the second mode may include: in response to the at least one dedicated outdoor air system performing the suction operation of the outdoor air, controlling the other dedicated outdoor air systems to perform the discharge operation of the indoor air; and in response to the at least one of the dedicated outdoor air systems performing the discharge operation of the indoor air, controlling the other dedicated outdoor air systems to perform the suction operation of the outdoor air.

Meanwhile, the operating in the second mode may include: in response to the at least one dedicated outdoor air system performing the suction operation of the outdoor air, controlling the other dedicated outdoor air systems to perform a simultaneous operation of sucking the outdoor air and discharging the indoor air simultaneously; and in response to the at least one dedicated outdoor air system performing the discharge operation of the indoor air, controlling the other dedicated outdoor air systems to perform a simultaneous operation of sucking the outdoor air and discharging the indoor air simultaneously.

Meanwhile, the operating in the second mode may include: among the plurality of dedicated outdoor air systems, controlling a dedicated outdoor air system, in which the sensed the indoor temperature data has a maximum value, to perform the discharge operation of the indoor air; among the plurality of dedicated outdoor air systems, controlling a dedicated outdoor air system, in which the sensed the indoor temperature data has a minimum value, to perform the suction operation of the outdoor air; and controlling the other dedicated outdoor air systems to perform the simultaneous operation of sucking the outdoor air and discharging the indoor air simultaneously.

Effects of the Invention

According to at least one of the embodiments of the present disclosure, a plurality of dedicated outdoor air systems installed in one indoor space may be operated efficiently.

In addition, according to at least one of the embodiments of the present disclosure, indoor comfort may be improved more rapidly by using the plurality of dedicated outdoor air systems.

Further, according to at least one of the embodiments of the present disclosure, the plurality of dedicated outdoor air systems may be controlled based on temperature uniformity of the indoor space, thereby uniformly improving comfort in the indoor space.

Various other advantages and effects will be disclosed explicitly or implicitly in the following detailed description of the embodiments of the disclosure to be described below in detail.

BRIEF DESCRIPTION OF THE DRAWINGS

FIG. 6 is a diagram referred to in the description of a temperature control mode of a dedicated outdoor air system according to an embodiment of the present disclosure.

FIGS. 7A and 7B are diagrams referred to in the description of an operation mode of a dedicated outdoor air system according to an embodiment of the present disclosure.

DETAILED DESCRIPTION OF THE PREFERRED EMBODIMENTS

Reference will now be made in detail to embodiments, examples of which are illustrated in the accompanying drawings. However, the present disclosure may be embodied in many different forms and should not be construed as limited to the embodiments set forth herein.

Meanwhile, terms "module" and "unit" to refer to elements used in the following description are given merely to facilitate explanation of the description, without having any significant meaning or role by itself. Therefore, the "module" and the "unit" may be used interchangeably.

Further, it should be understood that the terms "comprise", 'include", "have", etc. when used in this specification, specify the presence of stated features, numbers, steps, operations, elements, components, or combinations thereof, but do not preclude the presence or addition of one or more other features, numbers, steps, operations, elements, components, or combinations thereof.

In addition, it will be understood that, although the terms first, second, etc., may be used herein to describe various elements, these elements should not be limited by these terms. These terms are only used to distinguish one element from another.

Figure 1:
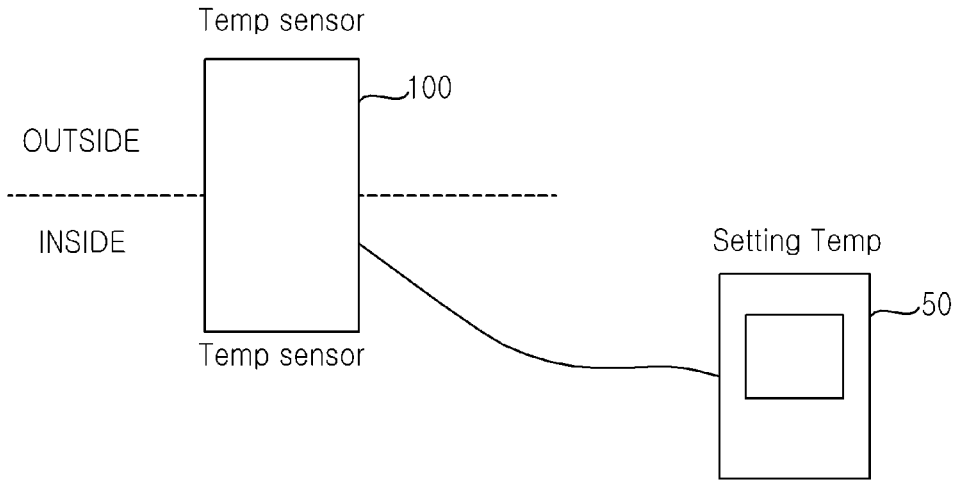
FIGS. 1 to 3 are diagrams referred to in the description of a dedicated outdoor air system according to an embodiment of the present disclosure.
Figure 2:
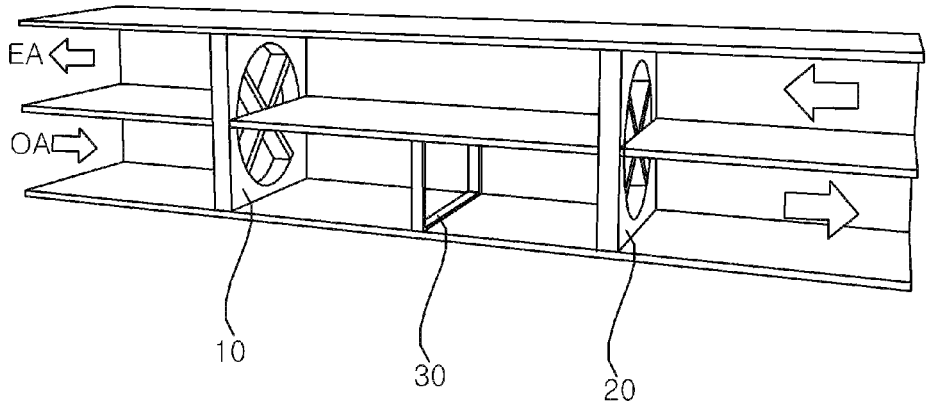
Figure 3:
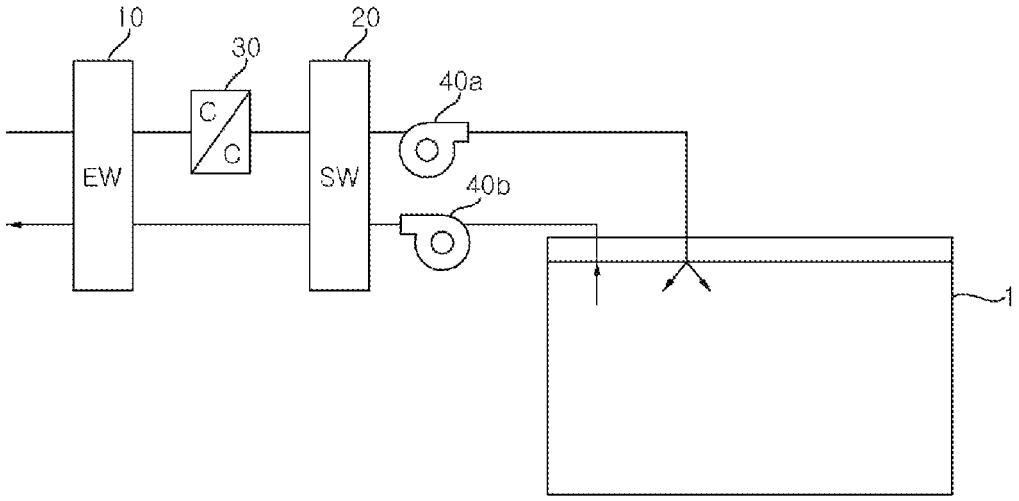

FIGS. 1 to 3 are diagrams referred to in the description of a dedicated outdoor air system according to an embodiment of the present disclosure.

FIG. 1 is a schematic diagram illustrating a dedicated outdoor air system and a controller, and FIGS. 2 and 3 are diagrams illustrating one general structure of a dedicated outdoor air system.

Referring to FIG. 1, a ventilation system according to an embodiment of the present disclosure includes one or more dedicated outdoor air systems (DOAS) 100.

The DOAS 100 may perform ventilation only with 100% outdoor air, and may increase cooling and heating efficiency by using waste heat recovered by a total heat exchanger.

Referring to FIGS. 2 and 3, the DOAS 100 includes a total heat exchanger 10, a sensible heat exchanger 20, and a cooling coil 30. Further, the DOAS 110 includes a supply fan 40*a* and an exhaust fan 40*b* to supply and exhaust air to and from an indoor space 1.

In summertime, the total heat exchanger 10 transfers heat and moisture, contained in the introduced outdoor air of high temperature and high humidity, to the exhaust air side of relatively low temperature and low humidity, thereby reducing cooling and dehumidification load imposed on the cooling coil 30.

In wintertime, the total heat exchanger 10 recovers heat and moisture contained in the exhaust air, and transfers the recovered heat and moisture to a cold and dry outdoor air side, thereby reducing energy used for heating and humidification.

The DOAS 100 may include at least one temperature sensor. For example, the DOAS 100, including an indoor temperature sensor, may sense indoor air temperature. Depending on embodiments, each DOAS 100, including an outdoor temperature sensor, may sense outdoor air temperature.

The DOAS 100 may be operated according to a set temperature received from the controller 50.

Further, the DOAS 100 may perform ventilation under the control of the controller 50. In some cases, the DOAS 100 may perform a cooling operation or a heating operation under the control of the controller 50.

The controller 50 may be a wired remote controller connected by wire to each DOAS 100. Alternatively, the controller 50 may be a wireless remote controller capable of controlling the DOAS 100. Alternatively, the controller 50 may be a central controller communicating with the DOAS 100 through wired or wireless communication and capable of controlling a plurality of dedicated outdoor air systems 100.

Depending on embodiments, the DOAS 100 may be operated as an indoor unit and may be connected to an outdoor unit (not shown) to receive a refrigerant from the outdoor unit, thereby performing a cooling operation or a heating operation more rapidly.

Depending on embodiments, the DOAS 100 may be operated by interworking with an air-conditioner performing a cooling operation or a heating operation, thereby managing indoor air more efficiently.

The ventilation system according to an embodiment of the present disclosure may include the DOAS 100 capable of continuously drawing outside fresh air into an indoor space by introducing outdoor air and discharging indoor air. In this case, the DOAS 100 may discharge indoor air to the outside by heat exchanging the indoor air, and may supply outdoor air into the indoor space by heat exchanging the outdoor air. To this end, the indoor units 100 may be connected to an air supply structure and an air exhaust structure 900 (see FIG. 9), such as a duct and the like.

Figure 4A:
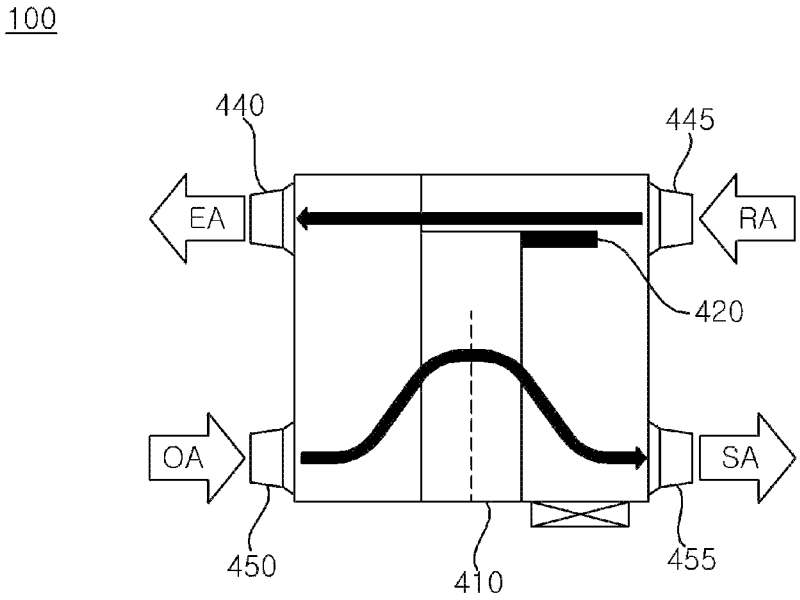
FIGS. 4A and 4B are diagrams illustrating operations of a dedicated outdoor air system and a damper according to an embodiment of the present disclosure.
Figure 4B:
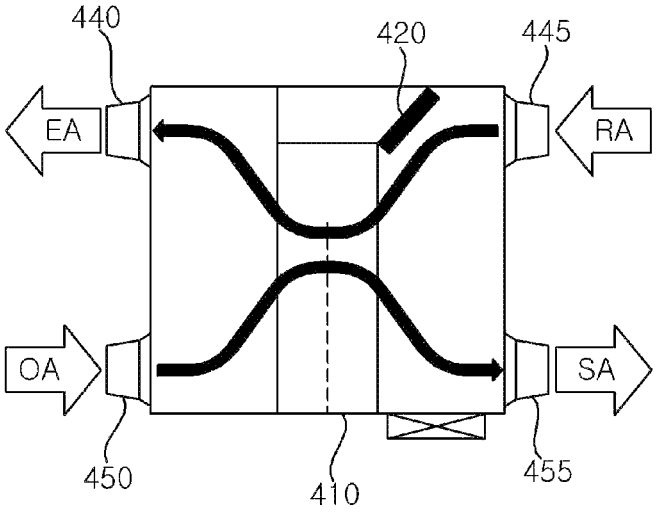

FIGS. 4A and 4B are diagrams illustrating operations of a dedicated outdoor air system and a damper according to an embodiment of the present disclosure.

The DOAS 100 includes: an exhaust air outlet 440, an exhaust air inlet 445, and an exhaust fan (not shown) for discharging indoor air to the outside; and an intake air inlet 450, an intake air outlet 455, and an intake fan (not shown) for discharging outdoor air (OA) to the outside. Further, at a point in a case where the exhaust ports 440 and 445 and the intake ports 450 and 455 intersect each other, the DOAS 100 includes a total heat exchanger 410 for heat exchange between sucked outside air and exhausted indoor air.

In addition, the DOAS 100 further includes a damper 420 for controlling the operation of the total heat exchanger 100. In this case, as illustrated in FIG. 4A, during a bypass operation for introducing outdoor air, the damper 420 may be disposed so that heat exchange may not be performed between an air supply passage (OA-SA), through which the outdoor air (OA) is supplied into a room, and an air exhaust passage (RA-EA) through which the indoor air (RA) is discharged to the outside. However, as illustrated in FIG. 4B, in the total heat exchange operation, the damper 420 may be disposed so that heat exchange may be performed between the air supply passage (OA-SA), through which the outdoor air (OA) is supplied into a room, and the air exhaust passage (RA-EA) through which the indoor air (RA) is discharged to the outside.

The following is an example of the operation of the DOAS 100.

First, when indoor air is contaminated to some extent, the exhaust fan operates such that the contaminated indoor air is introduced through the exhaust air inlet 445, and then passes through the total heat exchanger 410 to be discharged to the outside through the exhaust air outlet 440.

In addition, by the operation of the supply fan, fresh outdoor air is introduced through the intake air inlet 450, and then passes through the total heat exchanger 410 to be supplied into a room through the intake air outlet 455.

In this case, the indoor air and the outdoor air, passing through the total heat exchanger 410, are heat exchanged such that outdoor air at a temperature suitable for the room may be supplied. In this manner, by reducing a temperature difference between the indoor air and the outdoor air, it is possible to prevent abrupt change in the indoor temperature.

Meanwhile, by controlling an operation state of the total heat exchanger 410, the damper 420 may control the DOAS 100 to operate in the aforementioned total heat exchange mode or in a normal ventilation mode.

For example, as in summertime or wintertime when there is a large temperature or humidity difference between indoor air and outdoor air, the damper 420 may control the total heat exchanger 410 to be at a maximum height. That is, the damper 420 may control a vertical height of the total heat exchanger 410, having a square cross section, to be a diagonal line of the cross section. In this manner, total heat exchange may be actively performed between the sucked air and the exhausted air.

Then, in spring and fall when there is a small temperature or humidity difference between indoor and outdoor air, the damper 420 may control the total heat exchanger 410 to be at a minimum height. That is, the damper 420 may control a vertical height of the total heat exchanger 410, having a square cross section, to be the minimum height. That is, the damper 420 controls the total heat exchanger 410 to be in a bypass mode. In this manner, total heat exchange may be performed least between the sucked air and the exhausted air.

Figure 5:
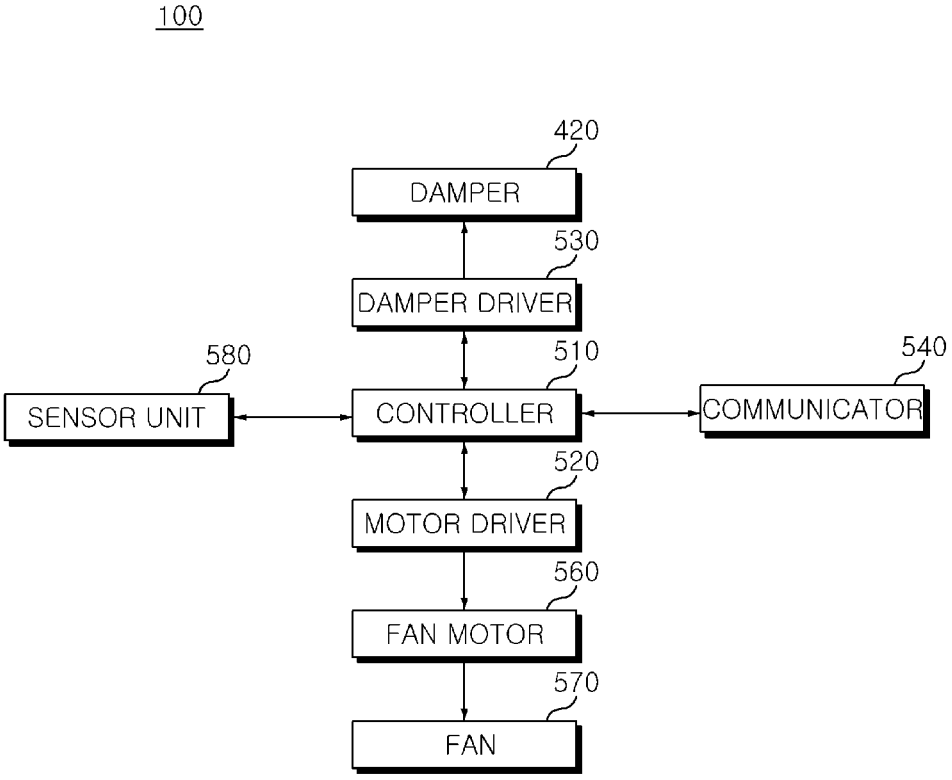
FIG. 5 is an internal block diagram illustrating a dedicated outdoor air system according to an embodiment of the present disclosure.

FIG. 5 is an internal block diagram illustrating a dedicated outdoor air system according to an embodiment of the present disclosure.

The DOAS 100 includes a controller 510 for controlling an overall operation of the DOAS 100, a fan motor 560 for rotating a fan 570, a motor driver 520 for driving the fan motor 560, the damper 420, a damper driver 530 for driving the damper 420, and a communicator 540.

The communicator 540 may communicate by wire and/or wirelessly with the controller 50, another DOAS 100, and various external sensors. The communicator 540 may be used to transmit or receive a control command or an operation state with other devices.

As described above, the controller 410 may control the damper driver 530 so that the damper 420 may operate in a total heat exchange mode or in a normal ventilation mode. Accordingly, the damper driver 530 may control a position of the damper 420 and the like.

In addition, the controller 510 may control the motor driver 520 for operating the fan motor 560. For example, the controller 510 may control on/off of the exhaust fan and the supply fan or an operating speed thereof, and the like.

To this end, the motor driver 520 may include a converter (not shown) for converting input AC power into DC power, a capacitor (not shown) for smoothing DC power, and an inverter (not shown) for converting DC power into AC power of a predetermined frequency and magnitude.

Further, in order to accurately control the operation of the motor, the motor driver 520 may sense an output current and an output voltage flowing through the fan motor 560, DC power stored in the capacitor, or input AC power, and may control a rotation speed of the motor 560 based on the sensed information. Meanwhile, the operation of the motor driver 520 is controlled by the controller 510.

Meanwhile, the ventilation system according to an embodiment of the present disclosure may include sensors disposed inside or outside thereof for obtaining various data associated with indoor and outdoor air. The sensors are used for sensing temperature, humidity, and air quality of at least the indoor space, and may include a temperature sensor, a humidity sensor, and a sensor for sensing the air quality of one or more of dust, CO2, Total Volatile Organic Compounds (TVOC), and the like. For example, the dust sensor may sense the concentration of dust for each dust particle size, and may sense the concentration by distinguishing the dust concentrations of PM 1.0, PM 2.5, and PM 10.0. In addition, the sensor may be composed of various sensor units.

Meanwhile, at least some of the sensors may be sensors included in the sensor unit 580 of each DOAS 100 in the ventilation system. For example, in the ventilation system, a temperature sensor and a humidity sensor included in one or more dedicated outdoor air systems 100 may be used. Further, by combining the sensed data of sensors included in each device, the ventilation system may manage data for each position or may improve accuracy of the sensed data.

In addition, the sensor may include a sensor disposed outdoors. For example, the sensor may be a temperature sensor or a dust sensor which is disposed outdoors.

Alternatively, the ventilation system may receive data sensed by an external sensor (not shown), and may use the data. At least one unit in the ventilation system may directly receive the sensed data from the external sensor or may receive the data from a server (not shown).

Meanwhile, devices, such as the controller 50, the DOAS 100, etc., included in the ventilation system may include a wired and/or wireless communication module, to communicate with another device or the server or to access a network.

In addition, devices included in the ventilation system may be connected through communication via a wired/wireless router (not shown). The devices included in the ventilation system may be connected to a predetermined server via a Wi-Fi communication module and the like, and may support smart functions, such as remote monitoring, remote control, and the like.

A user may operate the devices, included in the ventilation system, by using the controller 50. Depending on embodiments, the controller 50 having a display may provide information on at least one of the devices, included in the ventilation system, as visual information.

The controller 50 may be an integrated controller capable of controlling the overall operation of the devices included in the ventilation system, or may be a controller for controlling a specific device. Even when the controller 50 is a controller for controlling a specific device, if the specific device is a high priority device, the controller 50 may control other devices directly or through the specific device.

Meanwhile, depending on embodiments, the controller 50 may be a controller 510 of any one of the plurality of dedicated outdoor air systems 100 included in the ventilation system. The operation of the controller 50, which will be described below, may be performed by the controller 510 of any one of the plurality of dedicated outdoor air systems 100. The controller 50 may be a controller serving as a master in the ventilation system.

Meanwhile, the user may check or control information on the ventilation system using a mobile terminal (not shown).

The server may be a server operated by a manufacturer of the ventilation system, or a server operated by a company entrusted by the manufacturer with the task of providing services, and may store and manage information transmitted from the ventilation system. Information associated with the ventilation system may be transmitted to the controller 50, the mobile terminal, and individual devices, and the controller 50, the mobile terminal, and the individual devices may display the received information.

In addition, the DOAS 100 according to an embodiment of the present disclosure may operate in a temperature control mode based on temperature data sensed by the sensor in the ventilation system. The temperature control mode is performed to manage indoor temperature, and the DOAS 100 may operate in another sub-mode according to temperature data.

Further, according to an embodiment of the present disclosure, the ventilation system may control a plurality of devices by interworking the devices based on the data sensed by the sensors included in the plurality of dedicated outdoor air system 100. The ventilation system according to an embodiment of the present disclosure may operate in the temperature control mode based on indoor temperature data sensed by the indoor temperature sensor included in at least one DOAS 100.

FIG. 6 is a diagram referred to in the description of a temperature control mode of a dedicated outdoor air system according to an embodiment of the present disclosure.

The ventilation system according to an embodiment of the present disclosure may control temperature and may determine an operation mode by comparing indoor/outdoor temperature with a set temperature. The temperature control mode for controlling the indoor temperature may also be referred to as a normal operation mode or a first operation mode.

In the embodiment of FIG. 6, the first operation mode may include the following three sub operation modes: a heating mode, a cooling model, and a fan only mode.

Among the operation modes, the heating/cooling modes are controlled based on a refrigeration cycle. In the fan only mode among the operation modes, only the fan may operate. In the fan only mode, outdoor air is introduced into the room at a current temperature.

The controller 50 may determine the cooling/heating operation mode by comparing outdoor temperature with set temperature. In addition, the controller 50 may determine the cooling/heating operation mode by comparing indoor temperature with outdoor temperature. Further, the controller 50 may determine a final operation mode by comparing the set temperature with the indoor temperature.

Referring to FIG. 6, if the set temperature is higher than or equal to outdoor temperature, and if the indoor temperature is lower than the outdoor temperature, the controller 50 may determine the heating mode as the final operation mode.

In addition, if the set temperature and the indoor temperature are higher than or equal to the outdoor temperature, and if the set temperature is higher than the indoor temperature, the controller 50 may determine the heating mode as the final operation mode.

Further, if the set temperature and the indoor temperature are higher than or equal to the outdoor temperature, and the set temperature is lower than the indoor temperature, the controller 50 may operate in the fan only mode, thereby reducing energy consumption for heating.

Referring to FIG. 6, if the set temperature is lower than the outdoor temperature, and if the indoor temperature is higher than or equal to the outdoor temperature, the controller 50 may determine the cooling mode as the final operation mode.

In addition, if the set temperature and the indoor temperature are lower than the outdoor temperature, and if the indoor temperature is higher than the set temperature, the controller 50 may determine the cooling mode as the final operation mode.

Moreover, if the set temperature and the indoor temperature are lower than the outdoor temperature, and if the indoor temperature is lower than or equal to the set temperature, the controller 50 may operate in the fan only mode, thereby reducing energy consumption for cooling.

Figure 7B:
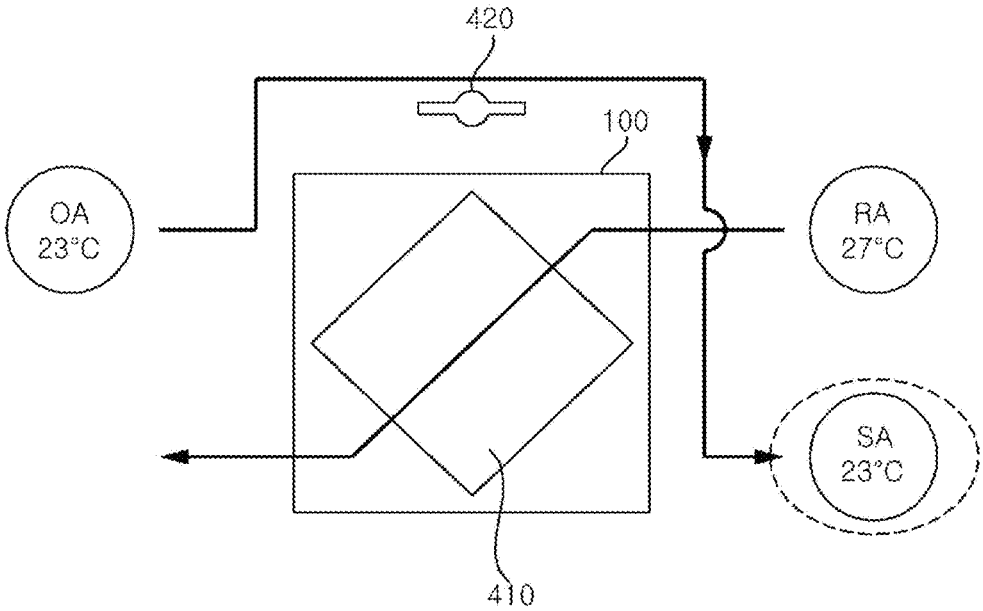

FIGS. 7A and 7B are diagrams referred to in the description of an operation mode of a dedicated outdoor air system according to an embodiment of the present disclosure.

The ventilation system may perform ventilation by introducing outdoor air into a room. The ventilation system may ventilate the room by simultaneously performing an operation mode for controlling temperature and a ventilation mode for controlling an air volume. In addition, the ventilation system may maximize the efficiency by interworking with an air-conditioning system that performs the cooling operation and/or heating operation. Meanwhile, the ventilation system may perform ventilation more rapidly by controlling a fan speed to adjust an air volume.

The outdoor air OA, the indoor air SA, and the exhaust air RA are main factors in the operation of the ventilation system. The ventilation system may improve energy efficiency by energy exchange between the exhaust air RA and the outdoor air OA.

Referring to FIGS. 7A and 7B, the damper 420 may operate to control the exhaust air RA and the outdoor air OA to pass or not to pass through the total heat exchanger 410.

Referring to FIG. 7A, if the indoor air SA has a higher temperature than the outdoor air OA having a temperature of 23 degrees, and if the indoor air SA has a higher temperature than the set temperature having a temperature of 24 degrees, the ventilation system may perform the cooling operation by using the total heat exchanger 410.

By the operation of the air exhaust fan, the exhaust air RA flows into the DOAS 100, and then passes through the total heat exchanger 410 to be discharged outside. Further, by the operation of the air supply fan, the outdoor air OA flows into the DOAS 100, and then passes through the total heat exchanger 410 to be supplied into the room through the intake air outlet 455. In this case, the indoor air and the outdoor air, passing through the total heat exchanger 410, are heat exchanged such that outdoor air at a temperature suitable for the room may be supplied.

If the temperature of the outdoor air OA, which is at 23 degrees, is equal to the temperature of the indoor air SA, no additional operation for cooling is required.

In the embodiment of FIG. 7B, the exhaust air RA passes through the total heat exchanger 410 and is discharged to the outside, but the outdoor air OA may flow into the room without passing through the total heat exchanger 410.

Alternatively, when no cooling is required, by varying the configuration of the damper 420 and the passages, the exhaust air RA may be discharged to the outside without passing through the total heat exchanger 410.

During ventilation, the indoor environment may not be maintained at a uniform temperature and air quality due to various factors. Accordingly, it is difficult to maintain air at a uniform set temperature in consideration of environments, such as the indoor structure, the number of people, heat generated in various devices, and the like. Particularly, in a large indoor space, it is difficult to achieve indoor comfort of the entire space.

According to an embodiment of the present disclosure, the plurality of dedicated outdoor air systems 100, each having one or more temperature sensors and configured to cause outdoor air to flow into a room and to cause indoor air to flow to the outside; and the controller 50 configured to control the plurality of dedicated outdoor air systems 100 based on temperature data sensed by the temperature sensors included in the plurality of dedicated outdoor air systems 100.

By using the temperature data sensed by the temperature sensors included in the plurality of dedicated outdoor air systems 100, the controller 50 may predict indoor circumstances and control ventilation, thereby maximizing indoor comfort.

Figure 8:
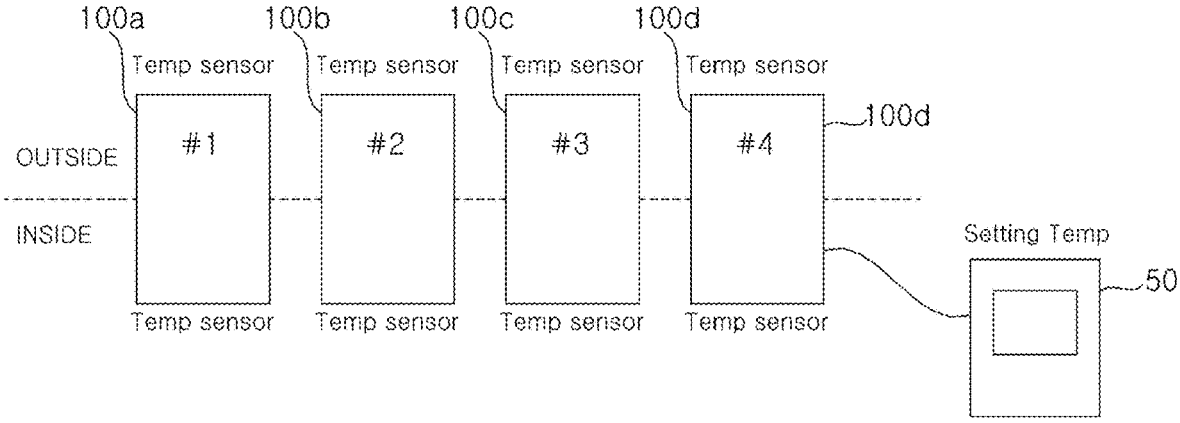
FIG. 8 is a diagram illustrating a configuration of a ventilation system according to an embodiment of the present disclosure.

FIG. 8 is a diagram illustrating a configuration of a ventilation system according to an embodiment of the present disclosure.

Referring to FIG. 8, the ventilation system according to an embodiment of the present disclosure may include the dedicated outdoor air systems 100*a*, 100*b*, 100*c*, and 100*d*, and the controller 50.

The dedicated outdoor air systems 100*a*, 100*b*, 100*c*, and 100*d* may be spaced apart from each other by a predetermined distance in a single indoor space.

The controller 50 may be a central controller capable of controlling the overall operation of the dedicated outdoor air systems 100*a*, 100*b*, 100*c*, and 100*d*. Alternatively, the controller 50 may be connected by wire or wireless to any one of the dedicated outdoor air systems 100*a*, 100*b*, 100*c*, and 100*d*. While FIG. 8 illustrates an example in which the controller 50 is connected by wire to the fourth dedicated outdoor air system 100*d* among the dedicated outdoor air systems 100*a*, 100*b*, 100*c*, and 100*d*, the present disclosure is not limited thereto. Meanwhile, the controller 50 may be a controller 510 of any one of the dedicated outdoor air systems 100*a*, 100*b*, 100*c*, and 100*d*.

The respective dedicated outdoor air systems 100*a*, 100*b*, 100*c*, and 100*d* may include at least an indoor temperature sensor. Accordingly, the respective dedicated outdoor air systems 100*a*, 100*b*, 100*c*, and 100*d* may sense indoor air temperature of a nearest region.

The ventilation system may determine temperature uniformity of the indoor space by combining the indoor temperature data sensed by the dedicated outdoor air systems 100*a*, 100*b*, 100*c*, and 100*d*.

Meanwhile, at least one of the dedicated outdoor air systems 100*a*, 100*b*, 100*c*, and 100*d* may include an outdoor temperature sensor. More preferably, all the dedicated outdoor air systems 100*a*, 100*b*, 100*c*, and 100*d* include the outdoor air temperature sensor to sense the temperature of outdoor air to be introduced by the respective dedicated outdoor air systems 100*a*, 100*b*, 100*c*, and 100*d*.

The controller 50 may control the plurality of dedicated outdoor air systems 100 based on the temperature data sensed by the temperature sensor included in the plurality of dedicated outdoor air systems 100*a*, 100*b*, 100*c*, and 100*d*.

The controller 50 may calculate an average value by combining the indoor temperature data sensed by the dedicated outdoor air systems 100*a*, 100*b*, 100*c*, and 100*d*. In addition, by comparing the calculated average value with the temperature data sensed by the respective dedicated outdoor air systems 100*a*, 100*b*, 100*c*, and 100*d*, the controller 50 may determine temperature uniformity of the indoor space based on a difference value between the sensed temperature data and the average value thereof.

If a difference between the indoor temperature data, sensed by all the dedicated outdoor air systems 100*a*, 100*b*, 100*c*, and 100*d*, and the average value thereof is less than or equal to a set reference value, the controller 50 may determine that the temperature uniformity is good, and may control the dedicated outdoor air systems 100*a*, 100*b*, 100*c*, and 100*d* to operate in the first operation mode described above with reference to FIG. 6.

Meanwhile, a ventilation operation for controlling a wind direction and the like of the dedicated outdoor air systems 100*a*, 100*b*, 100*c*, and 100*d* may include various modes. For example, the dedicated outdoor air systems 100*a*, 100*b*, 100*c*, and 100*d* may operate in a DOAS mode, an exhaust mode, and a supply mode in the ventilation mode. The DOAS mode is a mode for exhausting indoor air and introducing outdoor air, and may be referred to as a simultaneous operation mode. The exhaust mode is a mode for performing only a discharge operation of exhausting the indoor air to the outside, and the supply mode is a mode for performing only a suction operation of drawing the outdoor air into an indoor space.

Meanwhile, in the first operation mode, the dedicated outdoor air systems 100*a*, 100*b*, 100*c*, and 100*d* may basically perform the simultaneous operation for exhausting the indoor air and drawing in the outdoor air.

Based on the temperature uniformity of the indoor space in which the dedicated outdoor air systems 100*a*, 100*b*, 100*c*, and 100*d* are located, the controller 50 controls the dedicated outdoor air systems 100*a*, 100*b*, 100*c*, and 100*d* to operate in the first operation mode, in which all the dedicated outdoor air systems 100*a*, 100*b*, 100*c*, and 100*d* operate according to a set temperature, or controls at least one of the dedicated outdoor air systems 100*a*, 100*b*, 100*c*, and 100*d* to operate in the second operation mode in which at least one of the dedicated outdoor air systems 100*a*, 100*b*, 100*c*, and 100*d* operates in an operation mode different from the other dedicated outdoor air systems.

If there is no dedicated outdoor air system, in which a difference between the indoor temperature data, sensed by the indoor temperature sensors included in the respective dedicated outdoor air systems 100*a*, 100*b*, 100*c*, and 100*d*, and an average value of the indoor temperature data is greater than a reference value, the controller 50 may control the dedicated outdoor air systems 100*a*, 100*b*, 100*c*, and 100*d* to operate in the first operation mode.

Based on the outdoor temperature, the indoor temperature, and the set temperature, the controller 50 may control the dedicated outdoor air systems 100*a*, 100*b*, 100*c*, and 100*d* to perform the heating operation or the cooling operation, or the fan only operation for operating only a fan. In the first operation mode, the dedicated outdoor air systems 100*a*, 100*b*, 100*c*, and 100*d* basically operate in the same mode and according to the same setting, but if there is an input to the respective dedicated outdoor air systems 100*a*, 100*b*, 100*c*, and 100*d*, the dedicated outdoor air systems 100*a*, 100*b*, 100*c*, and 100*d* may operate according to the input.

In the first operation mode, the dedicated outdoor air systems 100*a*, 100*b*, 100*c*, and 100*d* may perform the simultaneous operation of sucking the outdoor air and discharging the indoor air at the same time.

Figure 9:
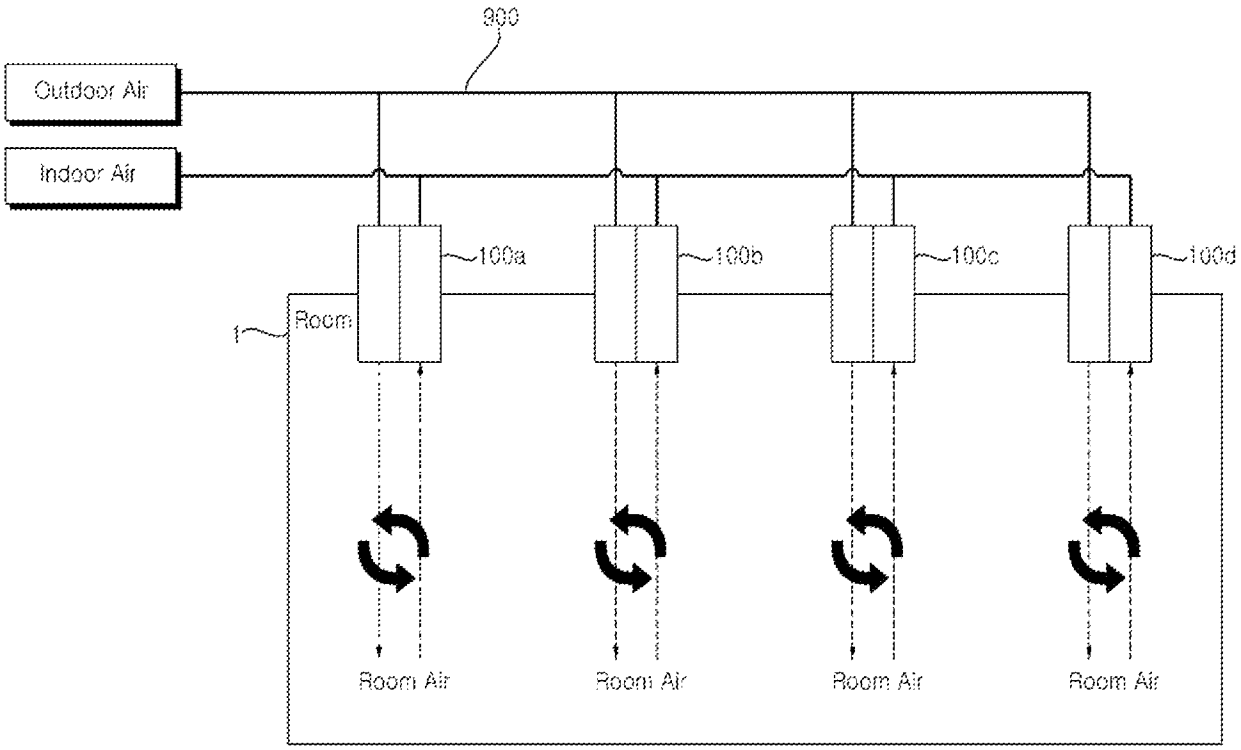
FIG. 9 is a diagram referred to in the description of a normal operation mode according to an embodiment of the present disclosure.

FIG. 9 is a diagram referred to in the description of a normal operation mode (first operation mode) according to an embodiment of the present disclosure, in which four dedicated outdoor air systems 100*a*, 100*b*, 100*c*, and 100*d* perform the simultaneous operation.

If the temperature uniformity is good, the dedicated outdoor air systems 100*a*, 100*b*, 100*c*, and 100*d* may operate in the first operation mode. In this case, determination as to whether to perform the cooling or heating operation may be made based on a comparison result of the outdoor temperature, the indoor temperature, and the set temperature.

Referring to FIG. 9, the dedicated outdoor air systems 100*a*, 100*b*, 100*c*, and 100*d* may perform exhaust and suction operations at the same time. Accordingly, the respective dedicated outdoor air systems 100*a*, 100*b*, 100*c*, and 100*d* may ventilate adjacent areas.

A space, in which the plurality of dedicated outdoor air systems 100*a*, 100*b*, 100*c*, and 100*d* are installed, may be considered a large space, and there may be a temperature difference in each region of the space.

According to an embodiment of the present disclosure, if there is a temperature difference in each region of a specific indoor space, the controller 50 may control the dedicated outdoor air systems 100*a*, 100*b*, 100*c*, and 100*d* to operate in the second operation mode, in which the dedicated outdoor air systems 100*a*, 100*b*, 100*c*, and 100*d* operate in a plurality of modes. Accordingly, by a combination of the dedicated outdoor air systems 100*a*, 100*b*, 100*c*, and 100*d* which operate in different modes, indoor comfort may be improved uniformly.

Meanwhile, if there is a dedicated outdoor air system in which a difference between the indoor temperature data, sensed by the indoor temperature sensors included in the respective dedicated outdoor air systems, and an average value of the indoor temperature data is greater than the reference value, the controller 50 may control the dedicated outdoor air system to operate in the second operation mode.

According to an embodiment of the present disclosure, in the second operation mode, the controller 50 may control at least one dedicated outdoor air system to perform only the suction operation of the outdoor air or only the discharge operation of the indoor air. In this case, the rest of the dedicated outdoor air systems may perform in other modes such as the simultaneous operation.

For example, when operating in the second operation mode during the cooling operation, a dedicated outdoor air system, having the highest temperature among the dedicated outdoor air systems 100*a*, 100*b*, 100*c*, and 100*d*, operates in a discharge only mode for only discharging the indoor air to the side, and the rest of the dedicated outdoor air systems operate in the DOAS mode. In this case, a vortex of air is generated in the indoor space, and by inducing improvement in uniform indoor air quality, comfort of indoor air may be improved.

Alternatively, in the case where at least one dedicated outdoor air system performs the suction operation of the outdoor air in the second operation mode, the controller 50 may control the rest of the dedicated outdoor air systems to perform the discharge operation of the indoor air.

Further, in the case where at least one dedicated outdoor air system performs the discharge operation of the indoor air, the controller 50 may control the rest of the dedicated outdoor air systems to perform the suction operation of the outdoor air.

According to an embodiment of the present disclosure, the controller 50 may control at least one dedicated outdoor air system to perform only the discharge operation, and at least one dedicated outdoor air system to perform only the suction operation, thereby forming a large vortex of air. The air vortex formed in the indoor space may facilitate air circulation, thereby resulting in uniform air quality.

According to an embodiment of the present disclosure, if the indoor temperature is lower than the set temperature during the cooling operation, the dedicated outdoor air systems 100*a*, 100*b*, 100*c*, and 100*d* may operate in the DOAS mode. If the indoor temperature is higher than the set temperature, a dedicated outdoor air system, in which the sensed indoor temperature data has a maximum value Max, may operate in the exhaust mode, a dedicated outdoor air system, in which the sensed indoor temperature data has a minimum value, may operate in the supply mode, and the rest of the dedicated outdoor air systems may operate in the DOAS mode.

According to an embodiment of the present disclosure, among the dedicated outdoor air systems 100*a*, 100*b*, 100*c*, and 100*d*, the dedicated outdoor air system, in which the sensed indoor temperature data has the maximum value, may operate in the exhaust mode of the indoor air, the dedicated outdoor air system, in which the sensed indoor temperature data has the minimum value, may operate in the suction mode of the outdoor air, and the rest of the dedicated outdoor air systems may operate in the simultaneous operation mode for drawing in the outdoor air and discharging the indoor air at the same time.

Meanwhile, in the second operation mode, the controller 50 may control the plurality of dedicated outdoor air systems 100*a*, 100*b*, 100*c*, and 100*d* based on a number of dedicated outdoor air systems, and a number of dedicated outdoor air systems in which a difference between the sensed indoor temperature data and an average value of the indoor temperature data is greater than the reference value.

For example, if the number of the dedicated outdoor air systems is two, one dedicated outdoor air system may perform the discharge operation of the indoor air, and the other one may perform the suction operation of the outdoor air, in the second operation mode. The dedicated outdoor air system performing the suction operation may draw in the indoor air and discharge the air to the outside, and the dedicated outdoor air system performing the discharge operation may draw in the outdoor air and discharge the air to the indoor space. Accordingly, a vortex may be formed in the indoor space in a direction from the dedicated outdoor air system performing the discharge operation toward the dedicated outdoor air system performing the suction operation, thereby improving uniformity of the indoor air quality.

If the number of the dedicated outdoor air systems is three, a detailed operation of the second operation mode may vary depending on the number of dedicated outdoor air systems in which a temperature difference is detected. As there are more dedicated outdoor air systems in which the temperature difference is detected, the number of dedicated outdoor air systems performing the discharge operation of sucking the indoor air and discharging the air to the outside increases, thereby rapidly improving uniformity of the air quality such as temperature.

For example, when there is one dedicated outdoor air system in which the difference between the sensed indoor temperature data and an average value of the indoor temperature data is greater than the reference value, the dedicated outdoor air system, in which the sensed indoor temperature data has the maximum value, may perform the discharge operation of the indoor air, and the other two dedicated outdoor air systems may perform the suction operation of the outdoor air.

In addition, when there are two dedicated outdoor air systems in which the difference between the sensed indoor temperature data and the average value of the indoor temperature data is greater than the reference value, the dedicated outdoor air system, in which the sensed indoor temperature data has the minimum value, may perform the suction operation of the outdoor air, and the remaining two dedicated outdoor air systems may perform the discharge operation of the indoor air.

Even when there are four dedicated outdoor air systems, a detailed operation of the second operation mode may vary depending on the number of dedicated outdoor air systems in which the temperature difference is detected.

Figure 10:
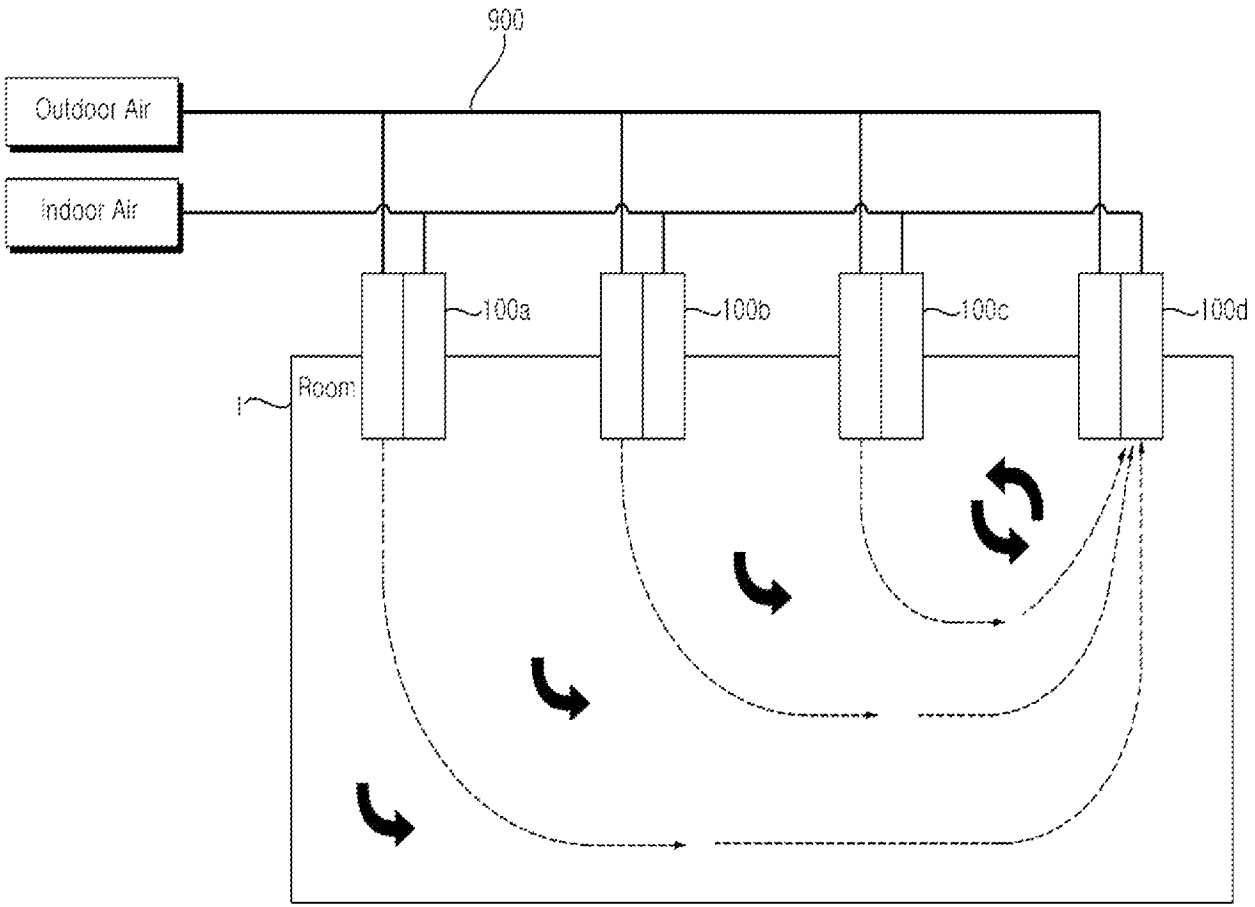
FIGS. 10 to 12 are diagrams referred to in the description of a wind direction control mode according to an embodiment of the present disclosure.
Figure 11:
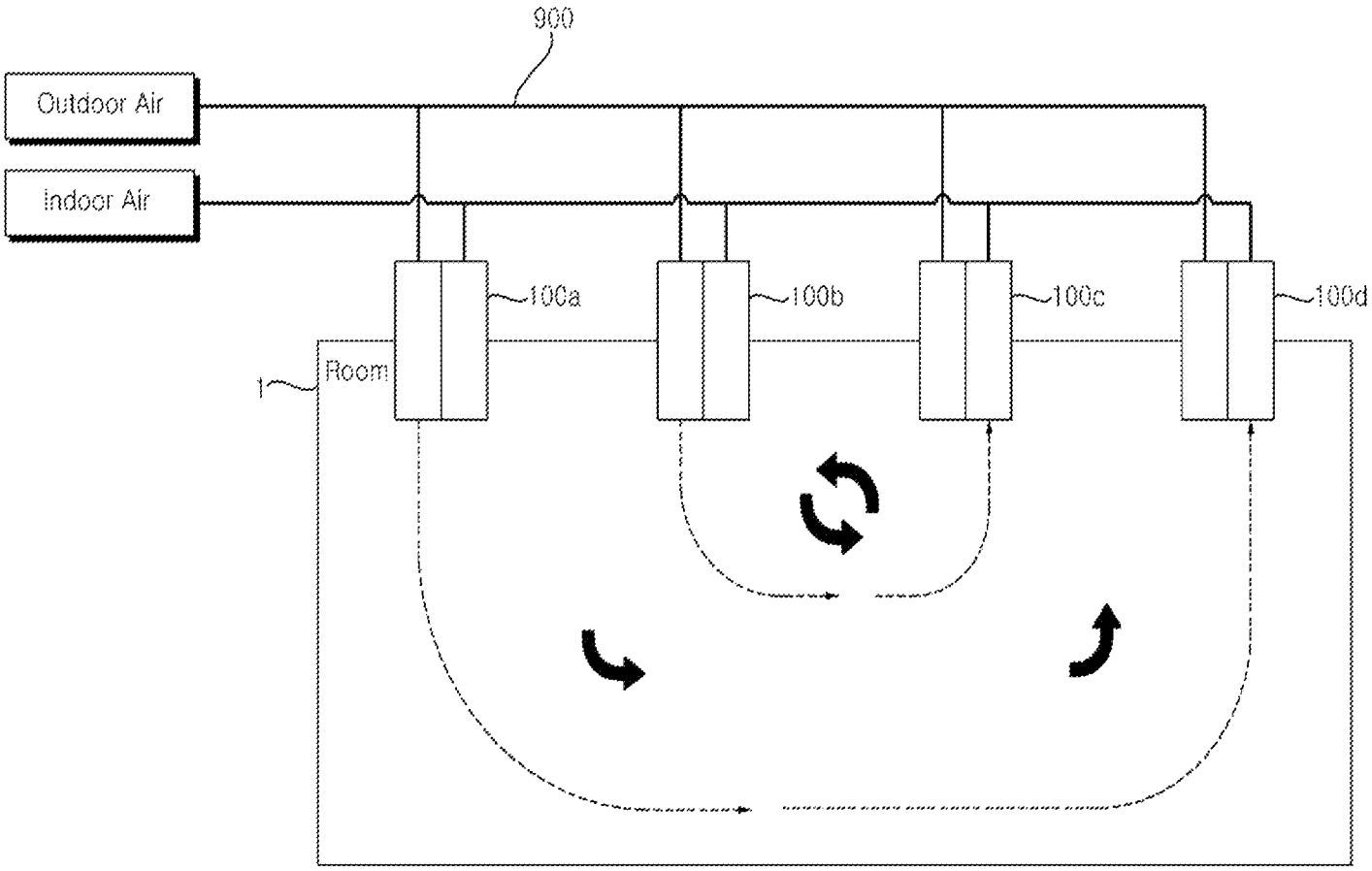
Figure 12:
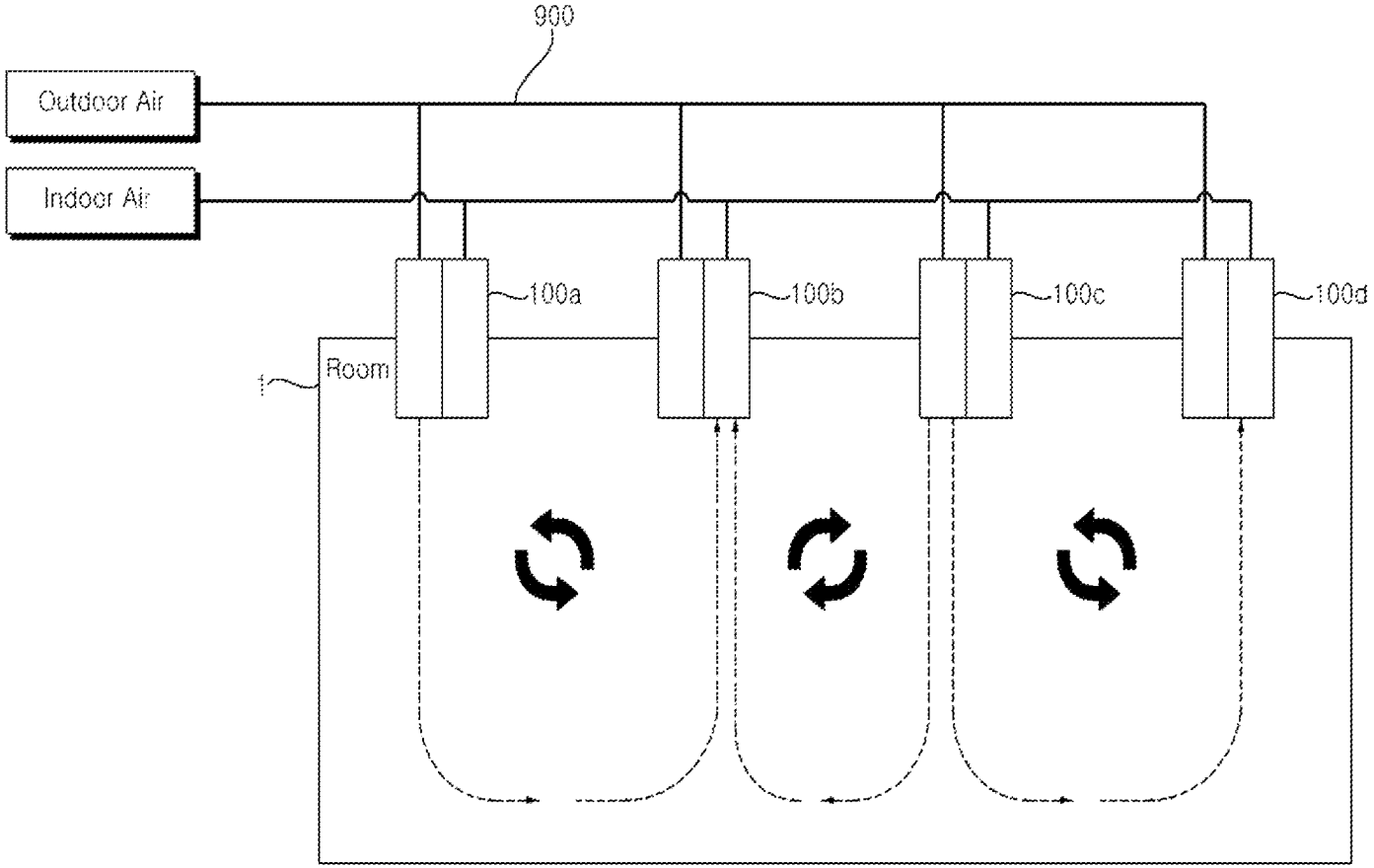

FIGS. 10 to 12 are diagrams referred to in the description of a wind direction control mode (second operation mode) according to an embodiment of the present disclosure, in which four dedicated outdoor air systems are installed.

FIG. 10 illustrates an example in which there is one dedicated outdoor air system in which a difference between sensed indoor temperature data and an average value of the indoor temperature data that is greater than a reference value.

In the dedicated outdoor air system 100*d* in which the sensed indoor temperature data has a maximum value, the controller 50 controls the dedicated outdoor air system to perform the discharge operation of the indoor air, and controls the remaining three dedicated outdoor air systems 100*a*, 100*b*, and 100*c* to perform the suction operation of the outdoor air.

Referring to FIG. 10, the fourth dedicated outdoor air system 100*d* may perform the discharge operation of sucking the indoor air and discharging the air to the outside, and the first to third dedicated outdoor air systems 100*a*, 100*b*, and 100*c* may perform the suction operation for sucking the outdoor air and discharging the air into the indoor space. Accordingly, an air flow may be formed in a direction from the first to third dedicated outdoor air systems 100*a*, 100*b*, and 100*c* to the fourth dedicated outdoor air system 100*d*.

By contrast, if there are three dedicated outdoor air systems in which the difference between the sensed indoor temperature data and the average value of the indoor temperature data is greater than the reference value, the controller 50 may control the dedicated outdoor air system, in which the sensed indoor temperature data has a minimum value, to perform the suction operation of the outdoor air, and may control the remaining three dedicated outdoor air systems to perform the discharge operation of the indoor air.

FIGS. 11 and 12 are diagrams illustrating an example in which there are two dedicated outdoor air systems in which a difference between sensed indoor temperature data and an average value of the indoor temperature data is greater than a reference value.

The controller 50 may control the two dedicated outdoor air systems, in which the difference between the sensed indoor temperature data and the average value of the indoor temperature data is greater than the reference value, to perform the discharge operation of the indoor air, and may control the remaining two dedicated outdoor air systems to perform the suction operation of the outdoor air.

Referring to FIG. 11, the third and fourth dedicated outdoor air systems 100*c* and 100*d* may perform the discharge operation of sucking the indoor air and discharging the air to the outside, and the first and second dedicated outdoor air systems 100*a* and 100*b* may perform the suction operation of sucking the outdoor air and discharging the air into the indoor space. Accordingly, an air flow may be formed in a direction from the first dedicated outdoor air system 100*a* to the fourth dedicated outdoor air system 100*d*, and in a direction from the second dedicated outdoor air system 100*b* to the third dedicated outdoor air system 100*c*.

Referring to FIG. 12, the second and fourth dedicated outdoor air systems 100*b* and 100*d* may perform the discharge operation of sucking the indoor air and discharging the air to the outside, and the first and third dedicated outdoor air systems 100*a* and 100*c* may perform the suction operation of sucking the outdoor air and discharging the air into the indoor space. Accordingly, an air flow may be formed in a direction from the first and third dedicated outdoor air systems 100*a* and 100*c* to the second dedicated outdoor air system 100*b*, and in a direction from the third dedicated outdoor air system 100*c* to the fourth dedicated outdoor air system 100*c*.

According to an embodiment of the present disclosure, if a non-uniform indoor air quality condition is satisfied, the indoor air may be forced to swirl so that ventilation may be performed to achieve uniform air quality.

Figure 13:
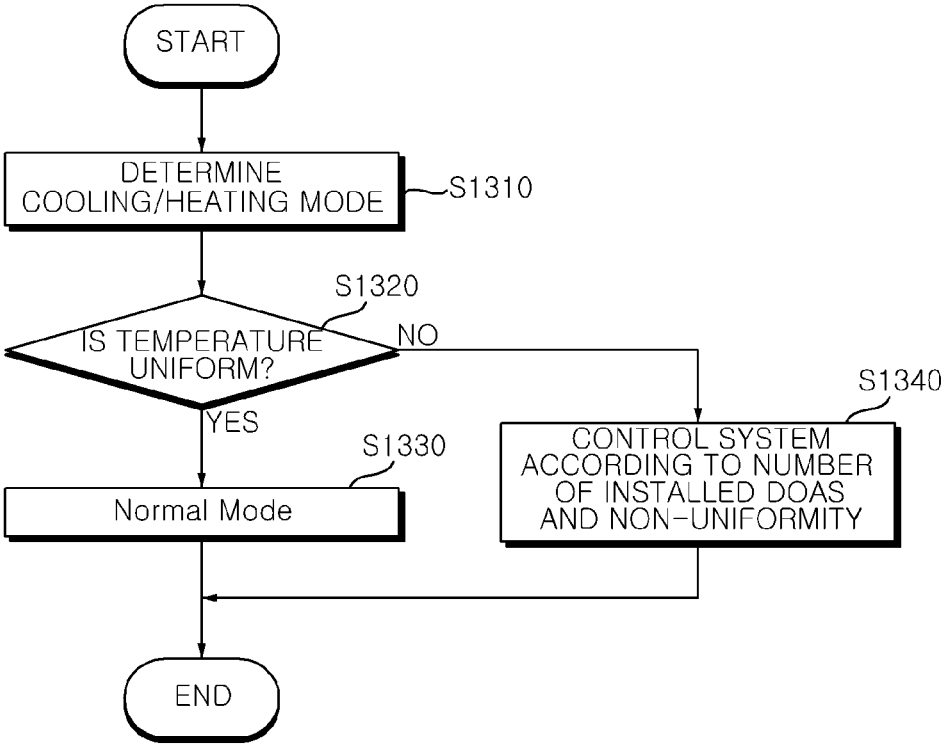
FIG. 13 is a flowchart illustrating a method of operating a ventilation system according to an embodiment of the present disclosure.

FIG. 13 is a flowchart illustrating a method of operating a ventilation system according to an embodiment of the present disclosure.

Referring to FIG. 13, the controller 50 may determine temperature uniformity of the indoor space in which a plurality of dedicated outdoor air systems 100 are installed (S1320).

By combining indoor temperature data sensed by the plurality of dedicated outdoor air systems 100, the controller 50 may calculate an average value of the data. In addition, by comparing the calculated average value with the temperature data sensed by the respective dedicated outdoor air systems 100, the controller 50 may determine the temperature uniformity of the indoor space based on a difference value therebetween.

Further, by comparing the calculated average value with the temperature data sensed by the respective dedicated outdoor air systems 100, the controller 50 may determine whether a temperature uniformity criterion is satisfied based on the difference value therebetween. The temperature uniformity criterion may be that there is no dedicated outdoor air system in which a difference between the indoor temperature data, sensed by the indoor temperature sensors included in the respective dedicated outdoor air systems, and an average value of the indoor temperature data is greater than a reference value.

That is, if there is even one dedicated outdoor air system in which the difference between the sensed indoor temperature data and the average value thereof is greater than the reference value, the controller 50 may determine that the indoor space does not satisfy the temperature uniformity criterion, and the temperature is non-uniform.

Meanwhile, if the temperature uniformity criterion is satisfied, the controller 50 may control all the dedicated outdoor air systems to operate in the first operation mode (S1330).

The controller 50 may determine the heating operation mode or the cooling operation mode based on the outdoor temperature, the indoor temperature, and the set temperature (S1310). In the first operation mode, a ventilation operation, such as sucking/discharging and the like, may be performed according to the determined operation mode.

Figure 14:
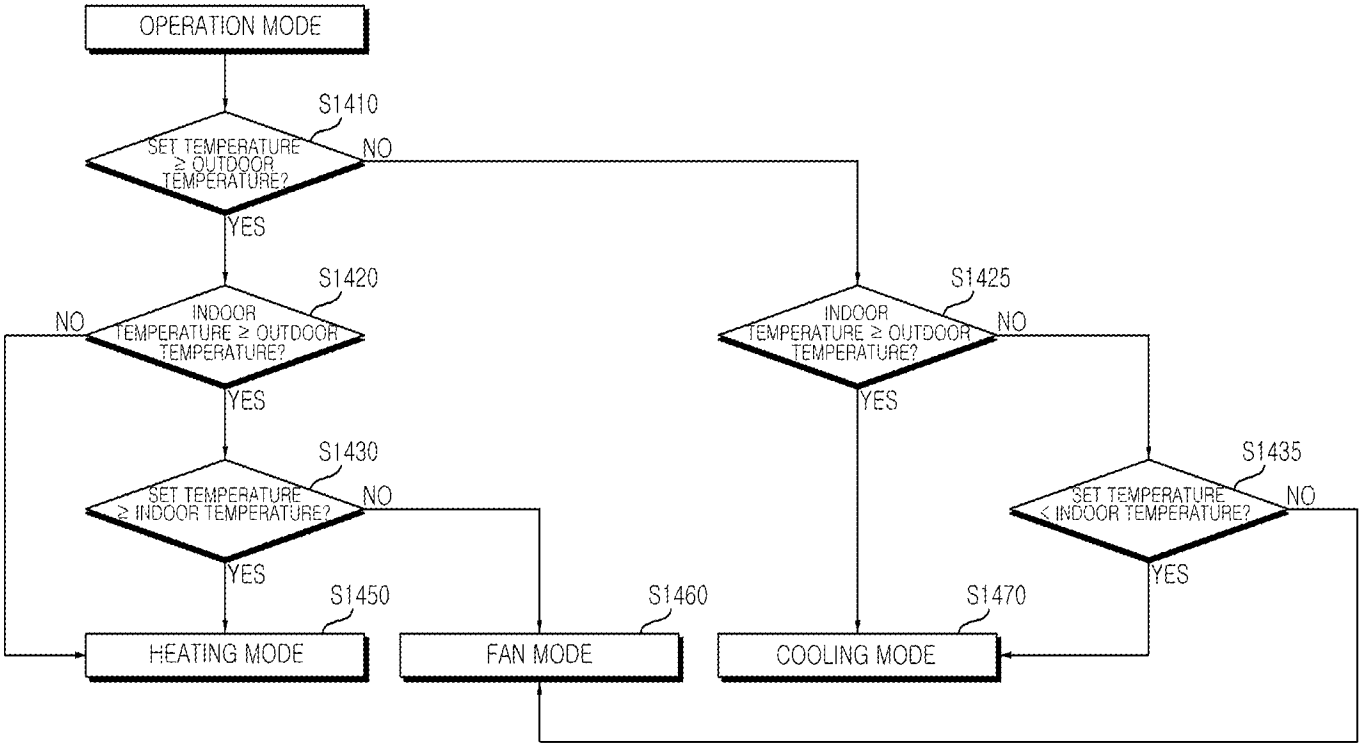
FIG. 14 is a flowchart illustrating a method of operating a ventilation system according to an embodiment of the present disclosure.

FIG. 14 is a flowchart illustrating a method of operating a ventilation system according to an embodiment of the present disclosure, in which an operation mode is controlled based on temperature.

Referring to FIG. 14, the controller 50 may compare the outdoor temperature with the set temperature (S1410). In addition, by comparing the indoor temperature/outdoor temperature, the controller 50 may determine the cooling operation/heating operation (S1420 and S1425). In addition, by comparing the set temperature with the indoor temperature, the controller 50 may determine a final operation mode (S1430 and S1435).

Referring to FIG. 14, if the set temperature is higher than or equal to the outdoor temperature (S1410), and the indoor temperature is lower than the outdoor temperature (S1420), the controller 50 may determine the heating mode as the final operation mode (S1450).

Further, if the set temperature and the indoor temperature are higher than the outdoor temperature (S1410 and S1420), and the set temperature is higher than the indoor temperature (S1430), the controller 50 may determine the heating mode as the final operation mode (S1450).

In addition, if the set temperature and the indoor temperature are higher than the outdoor temperature (S1410 and S1420), and the set temperature is lower than the indoor temperature (S1430), the controller 50 may operate only the fan in the fan only mode (S1460), thereby reducing energy consumption for heating.

Referring to FIG. 13, if the set temperature is lower than the outdoor temperature (S1410), and if the indoor temperature is higher than or equal to the outdoor temperature (S1425), the controller 50 may determine the cooling mode as the final operation mode (S1470).

Moreover, if the set temperature and the indoor temperature are lower than the outdoor temperature (S1410 and S1425), and the indoor temperature is higher than the set temperature (S1435), the controller 50 may determine the cooling mode as the final operation mode (S1470).

Furthermore, if the set temperature and the indoor temperature are lower than the outdoor temperature (S1410 and S1425), and the indoor temperature is lower than or equal to the set temperature (S1435), the controller 50 may operate only the fan in the fan only mode (S1460), thereby reducing energy consumption for heating.

Meanwhile, if the temperature uniformity criterion is not satisfied (S1320), the controller 50 may control at least one dedicated outdoor air system to operate in the second operation mode, which is a different mode from that of the rest of the dedicated outdoor air systems (S1340).

By controlling at least one dedicated outdoor air system to perform only the suction operation or the discharge operation, the controller 50 may form a vortex in the indoor space. Accordingly, an active air flow may be formed in the indoor space, thereby improving uniformity of air quality such as temperature and the like.

In the second operation mode, the controller 50 may control a plurality of dedicated outdoor air systems based on the number of dedicated outdoor air systems 100 included in the ventilation system, and a degree of temperature non-uniformity.

For example, if at least one dedicated outdoor air system performs the suction operation of the outdoor air, the controller 50 may control the rest of the dedicated outdoor air systems to perform the discharge operation of the indoor air; and if at least one dedicated outdoor air system performs the discharge operation of the indoor air, the controller 50 may control the rest of the dedicated outdoor air systems to perform the suction operation of the outdoor air.

In addition, among the plurality of dedicated outdoor air systems, if at least one dedicated outdoor air system performs the suction operation of the outdoor air, the controller 50 may control the rest of the dedicated outdoor air systems to perform the simultaneous operation of sucking the outdoor air and discharging the indoor air at the same time; and if at least one dedicated outdoor air system performs the discharge operation of the indoor air, the controller 50 may control the rest of the dedicated outdoor air systems to perform the simultaneous operation of sucking the outdoor air and discharging the indoor air at the same time.

Further, among the plurality of dedicated outdoor air systems 100, the controller 50 may control a dedicated outdoor air system, in which the sensed indoor temperature data has a maximum value, to perform the discharge operation of the indoor air, may control a dedicated outdoor air system, in which the sensed indoor temperature data has a minimum value, to perform the suction operation of the outdoor air, and may control the rest of the dedicated outdoor air systems to perform the simultaneous operation of sucking the outdoor air and discharging the indoor air at the same time.

According to at least one of the embodiments of the present disclosure, a plurality of dedicated outdoor air systems installed in one indoor space may be operated efficiently.

In addition, according to at least one of the embodiments of the present disclosure, indoor comfort may be improved more rapidly by using the plurality of dedicated outdoor air systems.

Further, according to at least one of the embodiments of the present disclosure, the plurality of dedicated outdoor air systems may be controlled based on temperature uniformity of the indoor space, thereby uniformly improving comfort in the indoor space.

The ventilation system and a method of operating the same according to the present disclosure are not limited to the configuration and method of the embodiments described above, but the embodiments may be configured by selectively combining all or part of each embodiment so that various modifications can be made.

While the present disclosure has been particularly shown and described with reference to preferred embodiments thereof, it will be understood by those skilled in the art that the present disclosure is not limited to those exemplary embodiments and various changes in form and details may be made therein without departing from the scope and spirit of the invention as defined by the appended claims and should not be individually understood from the technical spirit or prospect of the present disclosure.

What is claimed is:

1. A ventilation system, comprising:

a plurality of dedicated outdoor air systems, each having one or more temperature sensors and configured to cause outdoor air to flow into an indoor space and indoor air to flow outside thereof; and a controller configured to control the plurality of dedicated outdoor air systems based on temperature data sensed by temperature sensors included in the plurality of dedicated outdoor air systems, wherein the controller:

in response to temperature uniformity of the indoor space, in which the plurality of dedicated outdoor air systems are installed, satisfying a predetermined temperature uniformity criterion, controls all the dedicated outdoor air systems to operate in a first operation mode in which the dedicated outdoor air systems operate according to a set temperature; and in response to the temperature uniformity not satisfying the predetermined temperature uniformity criterion, controls the dedicated outdoor air systems to operate in a second operation mode in which at least one dedicated outdoor air system operates in a mode different from that of other dedicated outdoor air systems, wherein in response to there being a dedicated outdoor air system in which a difference between indoor temperature data, sensed by the indoor temperature sensors included in the respective dedicated outdoor air systems, and an average value of the indoor temperature data is greater than a reference value, the controller controls the dedicated outdoor air system to operate in the second operation mode, wherein in the second operation mode, the controller controls the plurality of dedicated outdoor air systems based on a number of the dedicated outdoor air systems, and a number of dedicated outdoor air systems in which the difference between the sensed indoor temperature data and the average value of the indoor temperature data is greater than the reference value, and wherein in the second operation mode, in response to there being four dedicated outdoor air systems, including one dedicated outdoor air system in which the difference between the sensed indoor temperature data and the average value thereof is greater than the reference value:

a dedicated outdoor air system, in which the sensed indoor temperature data has a maximum value, performs a discharge operation of the indoor air; and the remaining three dedicated outdoor air systems perform a suction operation of the outdoor air.

2. The ventilation system of claim 1, wherein in response to there being no dedicated outdoor air system in which the difference between the indoor temperature data, sensed by the indoor temperature sensors included in the respective dedicated outdoor air systems, and the average value of the indoor temperature data is greater than the reference value, the controller controls the dedicated outdoor air systems to operate in the first operation mode.

3. The ventilation system of claim 1, wherein in the first operation mode, the plurality of dedicated outdoor air systems perform a heating operation or a cooling operation, or a fan only operation of operating only a fan, based on outdoor temperature, indoor temperature, and set temperature.

4. The ventilation system of claim 1, wherein in the first operation mode, the plurality of dedicated outdoor air systems perform a simultaneous operation of sucking the outdoor air and discharging the indoor air simultaneously.

5. The ventilation system of claim 1, wherein in the second operation mode, in response to there being four dedicated outdoor air systems, including two dedicated outdoor air systems in which the difference between the sensed indoor temperature data and the average value thereof is greater than the reference value:

the two dedicated outdoor air systems, in which the difference between the sensed indoor temperature data and the average value thereof is greater than the reference value, perform the discharge operation of the indoor air; and the remaining two dedicated outdoor air systems perform the suction operation of the outdoor air.

6. The ventilation system of claim 1, wherein in the second operation mode, in response to there being four dedicated outdoor air systems, including three dedicated outdoor air systems in which the difference between the sensed indoor temperature data and the average value thereof is greater than the reference value:

a dedicated outdoor air system, in which the sensed indoor temperature data has a minimum value, performs the suction operation of the outdoor air; and the remaining three dedicated outdoor air systems perform the discharge operation of the indoor air.

* * * * *